US012378646B2

(12) United States Patent
Cabezas et al.

(10) Patent No.: US 12,378,646 B2
(45) Date of Patent: Aug. 5, 2025

(54) VERMICULAR CAST IRON ALLOY, COMBUSTION ENGINE BLOCK AND HEAD

(71) Applicant: TUPY S.A., Joinville (BR)

(72) Inventors: Carlos de Souza Cabezas, Joinville (BR); Eitan Melleras, Joinville (BR); Marina Furbino Martins, Joinville (BR)

(73) Assignee: TUPY S.A., Joinville (BR)

( * ) Notice: Subject to any disclaimer, the term of this patent is extended or adjusted under 35 U.S.C. 154(b) by 0 days.

(21) Appl. No.: 17/480,701

(22) Filed: Sep. 21, 2021

(65) Prior Publication Data

US 2022/0090238 A1 Mar. 24, 2022

(51) Int. Cl.
*C22C 37/10* (2006.01)
*C22C 33/08* (2006.01)

(52) U.S. Cl.
CPC ..... *C22C 37/10* (2013.01); *C22C 33/08* (2013.01); *C22C 2202/00* (2013.01)

(58) Field of Classification Search
CPC ..... C22C 37/10; C22C 33/08; C22C 2202/00
See application file for complete search history.

(56) References Cited

U.S. PATENT DOCUMENTS

| | | | | |
|---|---|---|---|---|
| 2008/0308193 | A1* | 12/2008 | Igarashi | C22C 37/04 148/333 |
| 2009/0123321 | A1 | 5/2009 | Shin | 420/17 |

FOREIGN PATENT DOCUMENTS

| | | | | |
|---|---|---|---|---|
| CN | 105385935 | A * | 3/2016 | B22D 1/00 |
| CN | 106929747 | A * | 7/2017 | C22C 33/08 |
| CN | 109811250 | A | 5/2019 | |
| EP | 0080590 | A2 | 6/1983 | |
| EP | 1724370 | A1 | 11/2006 | |
| WO | WO-84/02924 | A1 | 8/1984 | |
| WO | WO 2008/112720 | A1 | 9/2008 | |

OTHER PUBLICATIONS

English language machine translation of CN-106929747-A. Generated Oct. 21, 2023. (Year: 2023).*
English language machine translation of CN-105385935-A. Generated Oct. 21, 2023 (Year: 2023).*

* cited by examiner

*Primary Examiner* — Brian D Walck
(74) *Attorney, Agent, or Firm* — McCarter & English, LLP

(57) ABSTRACT

The present invention refers to a vermicular cast iron alloy specially designed for blocks and heads of internal combustion engines that have special requirements for mechanical strength and machinability; said vermicular alloy has a microstructure that results in high values of mechanical properties, such as a minimum strength limit of 500 Mpa, a minimum yield limit of 350 MPa, along with good machinability; also, wherein the ferritization factor must be such that it is between 3.88 and 5.48. This set of properties makes it possible to design new engine blocks and heads with complex geometry, high mechanical properties, without compromising machinability, making it attractive both from a technical and economic point of view.

6 Claims, 9 Drawing Sheets

(a)

(b)

STATE OF THE ART

VERMICULAR CAST IRON ALLOY, COMBUSTION ENGINE BLOCK AND HEAD

FIELD OF THE INVENTION

The present invention refers to a vermicular cast iron alloy specially designed for blocks and heads of internal combustion engines that have special requirements for mechanical strength and machinability; said vermicular alloy has a microstructure that results in high values of mechanical properties, such as a minimum strength limit of 500 Mpa, a minimum yield limit of 350 MPa, along with good machinability; also, wherein the ferritization factor must be such that it is between 3.88 and 5.48. This set of properties makes it possible to design new engine blocks and heads with complex geometry, high mechanical properties, without compromising machinability, making it attractive both from a technical and economic point of view.

BACKGROUND OF THE INVENTION

As it is common knowledge in the state of the art, the search for cast materials with high mechanical strength has been intense by the automotive industry, aiming to reduce the weight of automotive vehicles, the increase engine power and reduce gas emissions.

In particular, the properties of engine heads are particularly influenced by the composition of the iron alloys that make them up, since they present requirements for specific mechanical properties, and high stability at high temperatures.

Among the materials that present special requirements for engine heads, there is the vermicular cast iron, which is widely known by a person skilled in the art as being a material with excellent mechanical properties, with wide application in the manufacture of engine blocks and heads. The main characteristic of these materials is to present carbon in graphite veins, called graphite, surrounded by a metallic matrix. This graphite structure acts as the fragile phase in the material, wherein the mechanical property is defined by the morphology of this graphite and, also, the resistance given by the metallic matrix. FIG. 1 (state of the art) shows examples of different cast iron structures and the mechanical property characteristics thereof.

However, the automotive industry continually requires the production of increasingly powerful engines, making it necessary to develop new alloys that have better mechanical properties. Thus, there is a need to satisfy the demand for increasingly resistant vermicular cast irons.

Historically, the most used material for the manufacture of engine blocks and heads is gray cast iron, which tensile strength limit is around 250 MPa. Currently, with the emergence of more powerful and lighter engines, it was necessary to replace gray cast iron with a more resistant material, which is the case of vermicular cast iron. As shown in FIG. 1 B1, the main difference of this material in relation to gray cast iron is the way in which graphite is presented, with thicker and rounded veins.

This difference guarantees tensile strength limits up to 80% higher for vermicular cast irons. The vermicular cast iron class currently used to produce engine blocks and heads is the JV450 class. This material is characterized by having a strength limit equal to or greater than 450 MPa and a minimum yield limit of 0.2 of 315 MPa, according to ISO 16112/2017.

This greater strength brought new opportunities to designers, who were able to develop more powerful engines with less wall thickness. However, the new requirements of the emission legislation make this search for increasingly resistant materials to be constant, requiring the development of vermicular cast irons with mechanical resistance above 500 MPa.

The ISO 16112/2017 technical standard provides the JV500 vermicular cast iron class, which minimum tensile strength limit is 500 MPa and the flow and elongation limit values must be greater than 350 MPa and 0.5%, respectively, with fully pearlitic matrix. However, the feasibility of producing this alloy by the industry is still a challenge. The difficulty of producing pearlitic vermicular cast irons of superior strength is in the need to use high contents of alloying elements such as copper, tin and chromium, which end up imposing defects in the cast such as very high hardness or the formation of carbides in the microstructure, impairing both the machinability and the application of the material. Furthermore, high levels of alloying elements also translate into high production costs.

The SAE J1887 standard also provides the strength limit class of 500 MPa, with hardness up to 269 HB and maximum nodularity of 50%. However, the high nodularity reduces the material's thermal dissipation capacity, retaining more heat in the part and impairing its performance in the operation of combustion engines. In addition, very high nodularities end up harming the material's castability, causing defects in the casting part. FIG. 2 (state of the art) shows the porosity level of vermicular cast iron with less than 30% nodules and another with nodularity around 50%.

In turn, the ASTM A 842 standard does not yet foresee vermicular cast irons with mechanical strength above 500 MPa, since it limits the nodularity to a maximum value of 20%.

Another possibility to increase the mechanical strength of cast iron alloys is through the hardening of its metallic matrix. The most traditional is the use of pearlizing elements such as copper, tin and chromium. However, the use of these elements implies a considerable increase in the material's hardness, eventually causing the formation of carbides in its microstructure. This increase in hardness and the presence of carbides, extremely hard phase, is highly detrimental to the machinability of the material, making this operation unfeasible due to the high wear of the machining tools.

Therefore, there is a need to create a vermicular cast iron alloy with tensile strength limits higher than the current one, but which maintains good machinability and castability.

An alternative to the use of pearlite forming elements is the use of ferrite hardening elements, such as silicon. Silicon, being a strongly graphitizing element, favors the formation of a ferritic matrix in the cast iron.

Ferrite is known to be a soft phase that improves the toughness and elongation of the material. To allow ferritic cast iron to achieve hardness and tensile strength equivalent or superior to pearlitic vermicular iron, it is necessary to promote the hardening of this ferritic matrix. From the high contents of Si it is possible to harden the ferrite of vermicular cast iron by solid solution and obtain a material with high mechanical properties, without excessive increase in hardness.

Thus, it is possible to obtain a material with high mechanical properties, combined with good machinability. The increase in Si content has already been explored in nodular cast iron alloys, mainly to produce exhaust manifolds. Even these new alloys have already been included in the DIN EN 1536 standard. The new materials GJS-450-18, GJS-500-14 and GJS-600-10 provide a ferritic matrix with high tensile strength combined with greater elongation.

However, nodular cast iron cannot be used to produce engine blocks and heads due to its low thermal conductivity.

In addition, the simple application of silicon strips typical of nodular in vermicular cast irons does not guarantee the achievement of mechanical properties necessary for engine blocks and heads.

An example of high silicon content vermicular cast iron is patent WO 00/01860. This document reports the production of ferritic matrix vermicular iron, however, without reaching high levels of desired mechanical strength. The chemical composition described in this document is: 3.2-3.8% C; 2.8-4.0% Si and 0.005-0.025% Mg, insufficient combination both to achieve mechanical strengths above 500 MPa, as well as to obtain a 100% ferritic microstructure, with better machinability.

Furthermore, patent document CN106929747 describes a high strength vermicular cast iron alloy in which the hardening of the ferritic matrix occurs by solid solution and the composition of said alloy comprises silicon (Si), responsible for the high strength ferritic matrix, however in an amount that can still be considered reduced (% Si=3.0–4.8).

Finally, patents WO 2008/112720 and US 2009/0123321 describe cast irons with a Si-hardened ferritic matrix to obtain a higher strength class.

However, in both cases, the increase in mechanical strength is obtained by increasing the nodularization of the material and not by modifying the metallic matrix.

In the first case, the predicted nodularity is from 30 to 90%, which makes it impossible to use this alloy to produce engine blocks and heads, due to the low thermal dissipation of graphite in nodules. In the second case, the objective is the production of an alloy with high resistance to higher temperatures, which makes it necessary to add high levels of molybdenum, vanadium and nickel together with a greater amount of Si. The addition of these elements generates the formation of extremely hard particles of molybdenum or vanadium carbides in the microstructure, greatly impairing the component's machinability. As such, this alloy is only suitable to produce turbine housings or smaller components that require few machining operations.

Therefore, the high silicon materials mentioned in the previous documents are not suitable for the manufacture of engine blocks and heads. Whether due to low mechanical strength or inappropriate properties such as high nodularity, or due to the intense use of alloying elements, which makes it impossible to machine complex components such as blocks and engine heads.

In the specific case of blocks and heads of internal combustion engines, machinability is an important property that is reflected in the cost of the product, since these parts are usually extensively machined until the final product is obtained.

Thus, it can be seen that, in the current state of the art, there is still a demand for new compositions of cast iron alloys that have the proper properties for the manufacture of internal combustion engine heads. It is based on this scenario that the invention in question arises.

INVENTION OBJECTIVES

Therefore, it is the main objective of the present invention to provide a vermicular cast iron alloy specially designed for blocks and heads of internal combustion engines that have special requirements in terms of mechanical strength and machinability.

Furthermore, the objective of the present invention is to provide an alloy with a minimum strength limit of 500 MPa, a minimum yield limit of 350 MPa, along with a good machinability, this last characteristic being the main differential of this invention.

Finally, the objective of this invention is to provide an internal combustion engine head and an internal combustion engine block made of vermicular cast iron alloy.

SUMMARY OF THE INVENTION

All the objectives of the invention in question are achieved by means of a vermicular cast iron alloy comprising carbon contents in the range of 2.6% to 3.2%, manganese values between 0.1% to 0.3%, phosphorus maximum of 0.05%, chromium less than 0.06%, tin less than 0.03% and copper less than 0.20%; the alloy being especially defined for having a microstructure with a ferritic matrix comprising at least 90% ferrite and at least 70% vermicular graphite; said alloy comprising silicon in the range of 4.60% to 5.70%; and wherein the Ferritization Factor (F.F.) calculated as F.F.=% Si−% Cu−10×% Sn−1.2×% Cr−0.5×% Mn is between 3.88 to 5.48.

Furthermore, the object of the present invention is a vermicular cast iron alloy that presents graphite nodules in up to 30% of the microstructure.

Also, the object of the present invention is a vermicular cast iron alloy, according to claim 1, which has a minimum strength limit of at least 500 MPa and a minimum yield limit of at least 350 Mpa.

Additionally, the present invention provides an internal combustion engine head made of vermicular cast iron alloy.

Finally, the present invention provides an internal combustion engine locus made of vermicular cast iron alloy.

BRIEF DESCRIPTION OF FIGURES

Preferred embodiment of the present invention is described in detail based on the listed figures, which are exemplary and not limiting.

DETAILED DESCRIPTION OF THE INVENTION

The present invention relates to vermicular cast iron alloy, especially defined by having a microstructure with a ferritic matrix comprising at least 90% ferrite and at least 70% vermicular graphite, said alloy comprising silicon in the range of 4.80% to 5.70% and wherein the Ferritization Factor is calculated as F.F.=% Si−% Cu−10×% Sn−1.2×% Cr−0.5×% Mn is between 3.88 to 5.48.

The proposal of the present patent arises to produce a vermicular cast iron with a ferritic matrix with high Si content and a maximum nodularity of 30% for the manufacture of engine blocks and heads, which tensile strength limit is greater than 500 MPa.

The feasibility of producing vermicular cast iron with a strength limit greater than 500 MPa and good machinability creates new opportunities for the automotive sector. The mechanical properties provided by this alloy allow the manufacture of engine blocks and heads with greater geometric complexity and greater power and performance.

Therefore, the present invention meets the demand of the industry by combining sustainability with this production, as new projects with this alloy allow the manufacture of engines with lower pollutant emissions.

Obtaining cast iron with graphite in vermicular form is possible through controlled additions of magnesium, which is the graphite modifier element, so that the final magnesium content is between 0.008-0.030% Mg.

In addition to the controlled addition of magnesium through the addition of Fe—SiMg alloy, the addition of cerium and inoculant (FeSi75) is also controlled. Cerium, also known as rare earths, plays a role similar to magnesium, while the inoculant has the function of favoring the nucleation of graphite. The addition of cerium must correspond to 2-3 times the amount of sulfur present in the base metal.

Figure 3:
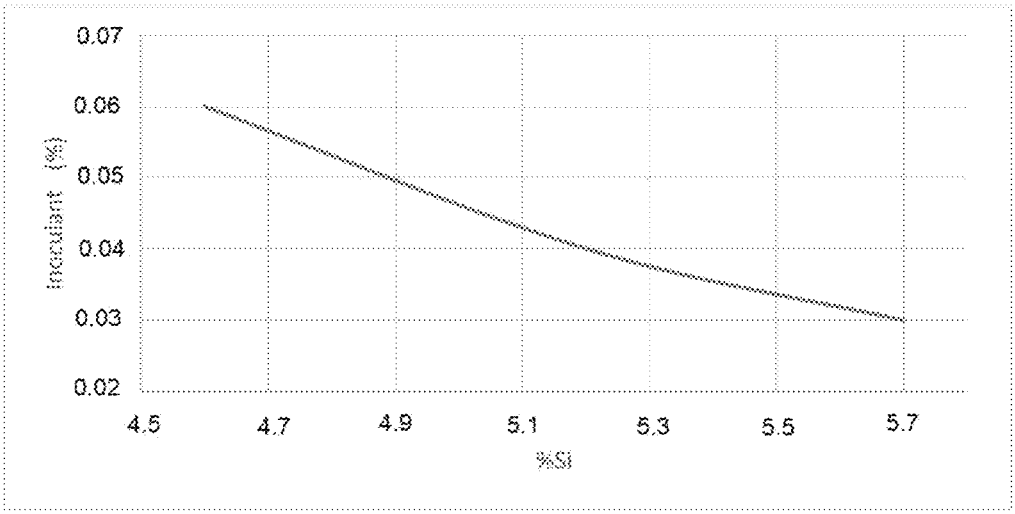
FIG. 3—Relationship between the amount of inoculant used as a function of the silicon content.

The amount of inoculant added depends on the Si content in the alloy and the capacity of the pan used. This relationship is shown in FIG. 3.

The chemical composition of the new alloy differs from the composition of conventional class 450 vermicular cast iron mainly by its low C content (2.6-3.2%), high Si content (4.6-5.7%) and residual values of perlitizing elements.

To ensure the formation of ferrite associated with high mechanical properties, a Ferritization Factor between 3.88 and 5.48 must be defined as:

$$\text{Ferritization Factor} = \%\,Si - \%\,Cu - 10\times\%\,Sn - 1.2\times\%\,Cr - 0.5\times\%\,Mn.$$

Figure 4:
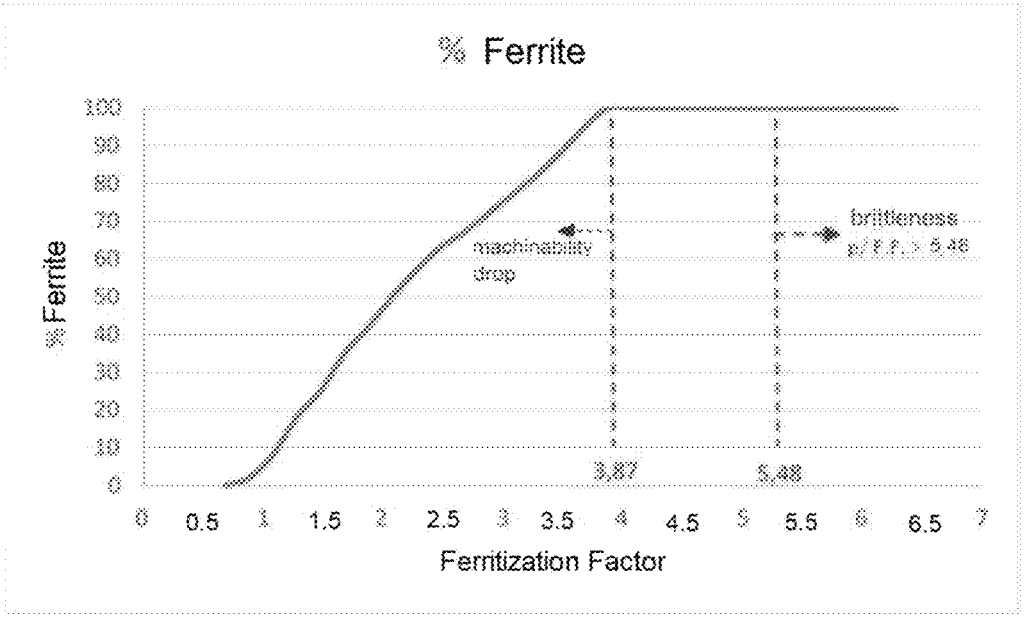
FIG. 4—Ferrite proportion according to the ferritization factor of a vermicular cast iron.

For values lower than 3.88, pearlite is formed, with a consequent increase in hardness and a drop in machinability, as shown in the graph in FIG. 4. Above these values, the material becomes extremely fragile, making its application impossible.

Figure 5:
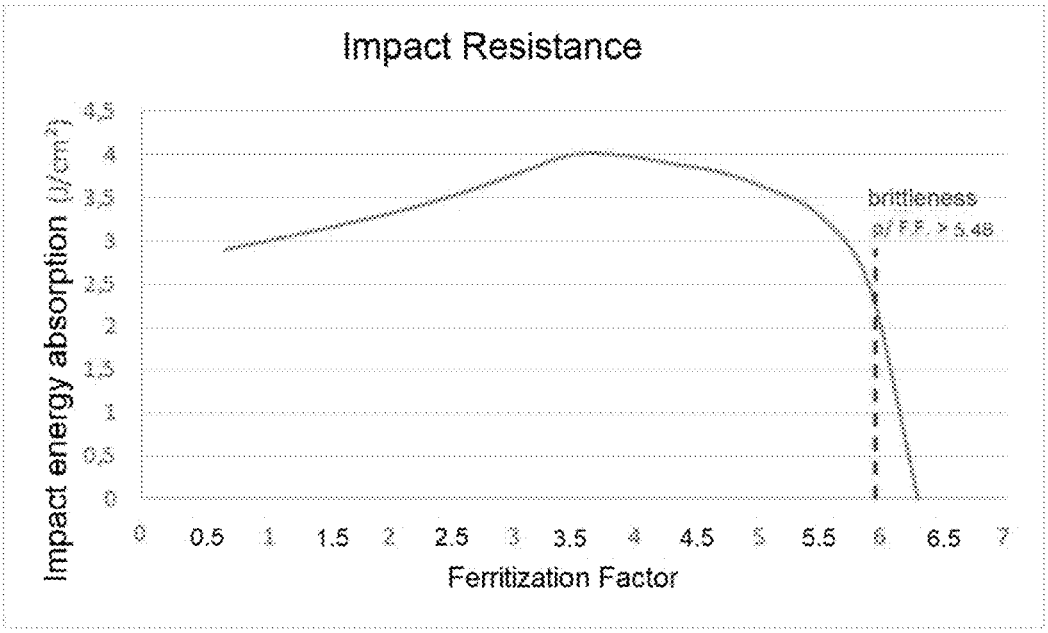
FIG. 5—Impact Resistance of a high silicon vermicular cast iron according to the Ferritization Factor. Data obtained from U-notch specimens.

The graph in FIG. 5 shows the evolution of impact energy absorption values according to the Ferritization Factor.

Typical levels of elements for the material claimed by this document compared to conventional class 450 vermicular cast iron are shown in table 1.

| Element | High Si Vermicular Iron, class 500 | Class 450 Vermicular Iron |
|---|---|---|
| Carbon | 3.2-3.8% | 2.6-3.2% |
| Silicon | 2.0-2.5% | 4.6-5.7% |
| Sulfur | <0.030% | <0.015% |
| Manganese | <0.5% | 0.1-0.3% |
| Copper | <1.0% | <0.06% |
| Tin | <0.1% | <0.01% |
| Magnesium | 0.005-0.030% | 0.005-0.030% |
| Cerium | 0.005-0.030% | 0.005-0.030% |

Figure 6:
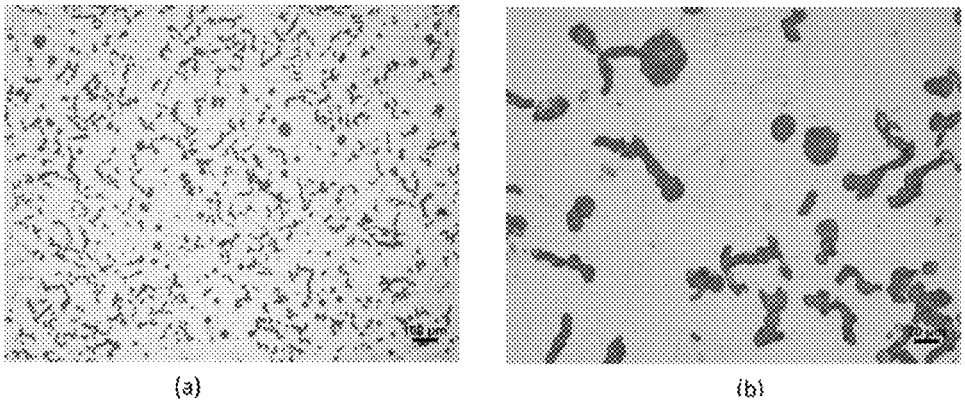
FIG. 6—Micrographs of the ferritic matrix vermicular cast iron object of the present invention: a) optical microscopy, magnification of 100×, with attack; b) optical microscopy, magnification of 500×, with attack.

From the chemical composition described in Table 1 and complying the Ferritization Factor range between 3.88 and 5.48, the material in this document reaches high values of tensile strength limit, above 500 MPa combined with the minimum yield limit of 350 MPa with a ferritic matrix. This microstructure can be seen in FIG. 6.

In a preferred embodiment, the silicon Si content in the alloy can range between 4.8-5.7%.

Thus, to obtain the present material within these ranges of chemical composition, the base metal must be prepared in the furnace with a high silicon content between 4.4 and 4.7% and a sulfur content not exceeding 0.020%.

Figure 1:
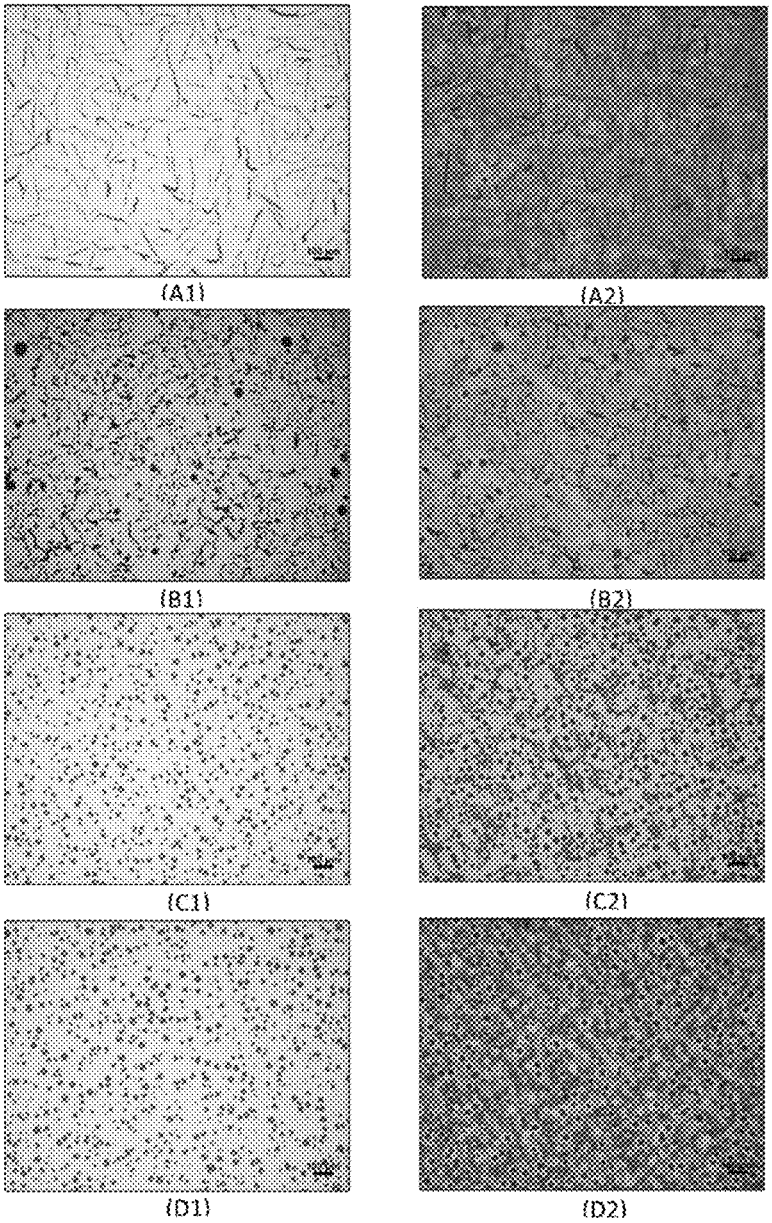
FIG. 1—Typical microstructure of a class 250 gray cast iron, (A1) without attack and (A2) with attack, showing the predominantly pearlitic matrix; typical microstructure of a class 450 vermicular cast iron, (B1) without attack, evidencing the shape of the graphite particles and (B2) with attack, evidencing the predominantly pearlitic matrix; typical microstructure of a class 400 nodular cast iron, (C1) without attack, evidencing the shape of the graphite particles and (C2) with attack, evidencing the matrix constituted by similar fractions of ferrite and pearlite; typical microstructure of a class 600 nodular cast iron, (D1) without attack, evidencing the shape of the graphite particles and (D2) with attack, evidencing the predominantly pearlitic matrix.
Figure 2:
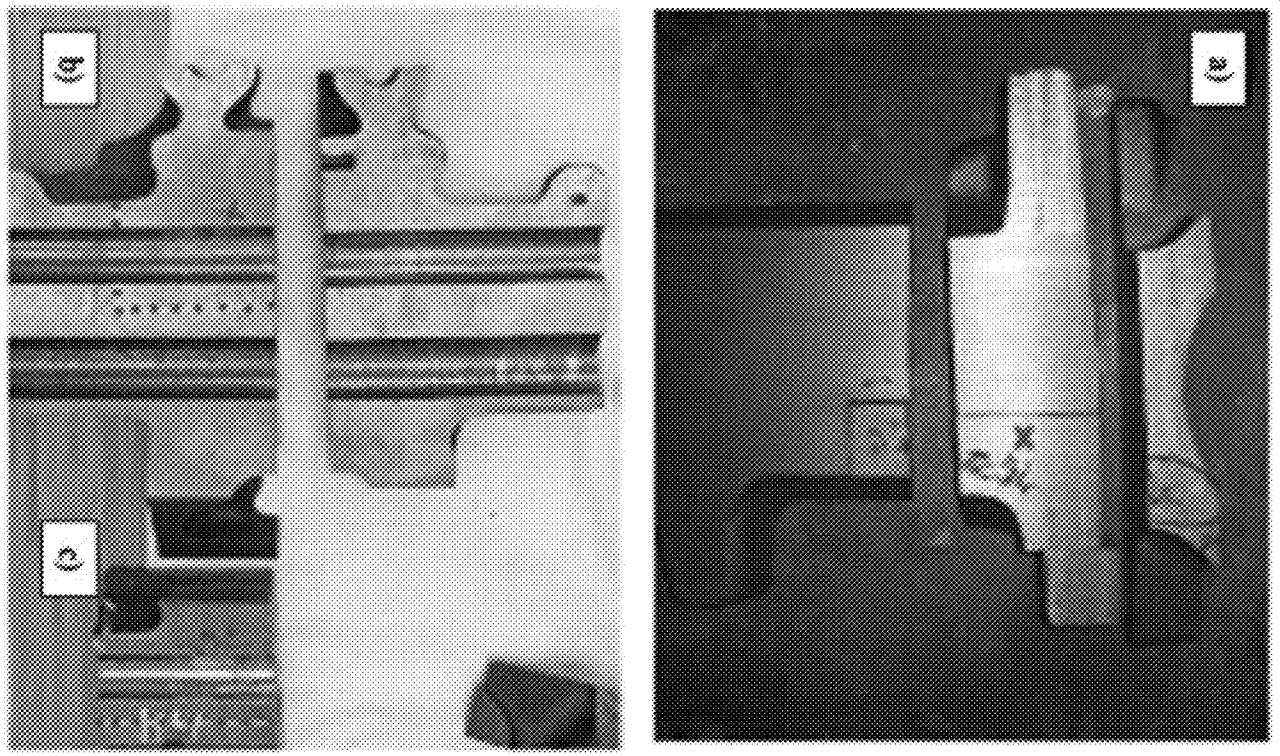
FIG. 2—(a) part of an engine block with 50% nodularity and high porosity index, (b) part of an engine block with 10% nodularity and free of porosity, (c) part of a block engine with 20% nodularity and low porosity index.

Then the base metal must be transferred from the furnace to a leaking or treatment pan. The metal is then treated with pre-calculated amounts of magnesium and cerium as shown. Next, the inoculant is added in the appropriate amount, following the proportions described in the graph in FIG. 2 and, finally, the liquid metal is poured into convenient molds.

In addition to accurately calculating all additions made to the pan, process temperatures must also be well controlled. For the furnace, the approximate temperature of 1550° C. is indicated and the leaking must take place at temperatures from 1370 to 1450° C.

The result is to obtain a high silicon vermicular cast iron, with a predominantly ferritic matrix. The graphite format is predominantly vermicular (form III of the ISO 945/1975 standard [9])—above 70%, and there is also the presence of graphite in nodules (form VI of the ISO 945/1975 standard [9]) at a maximum of 30%.

The main factor that favors the higher strength limit, without machinability drop, of this new type of vermicular cast iron is the combination of chemical elements that comply with the Ferritization Factor between 3.88 and 5.48, responsible for the hardening by solid solution of the ferritic matrix.

Figure 7:
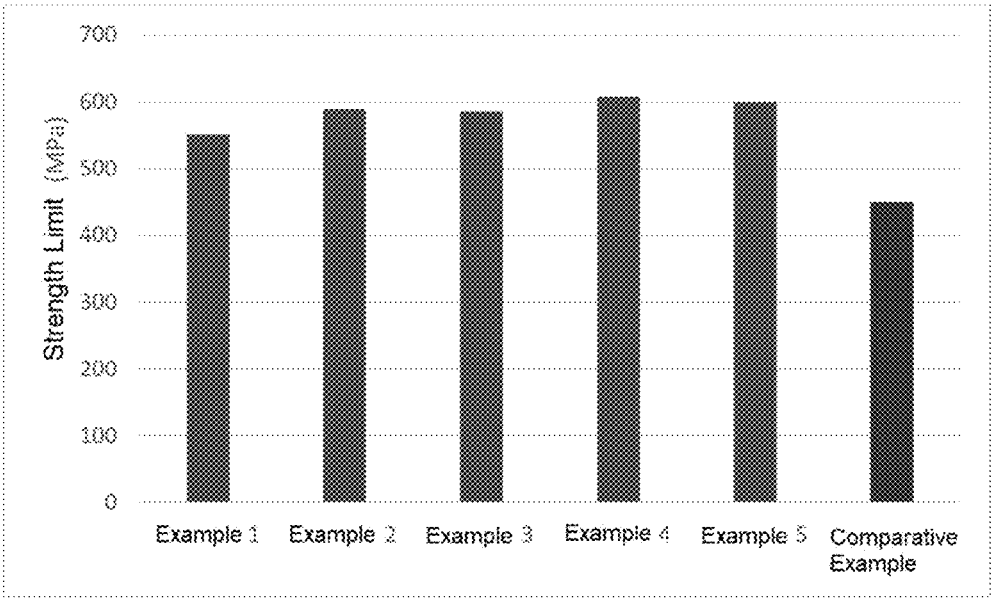
FIG. 7—strength limit results for the ferritic vermicular cast iron object of the present invention. The comparative example is for class 450 vermicular cast iron. The average strength limit is 587 MPa for the present material.
Figure 8:
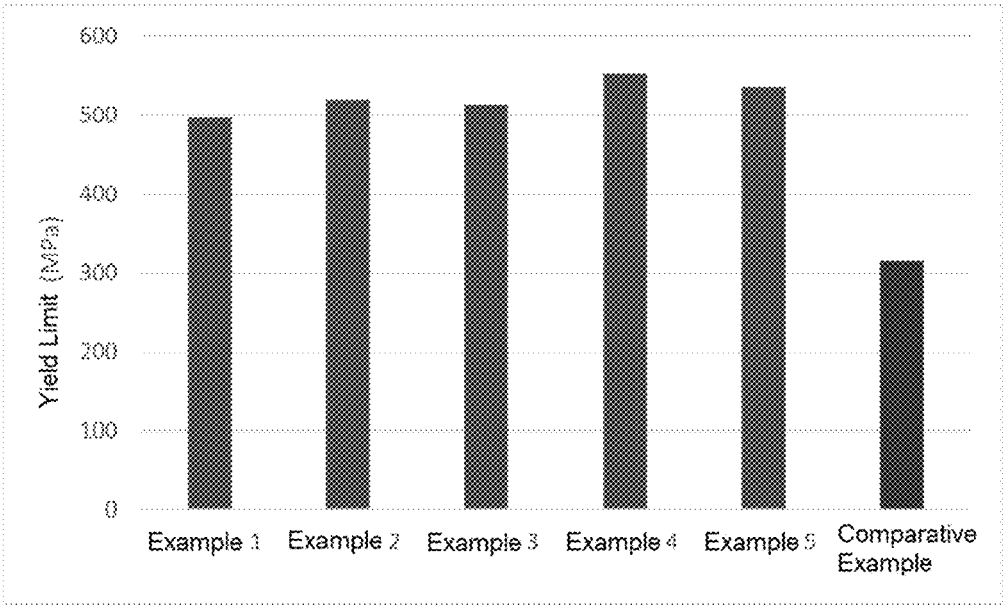
FIG. 8—Yield limit results for the ferritic vermicular cast iron object of the present invention. The comparative example is for class 450 vermicular cast iron. The average yield limit is 523 MPa for the high silicon vermicular cast iron in this document.
Figure 9:
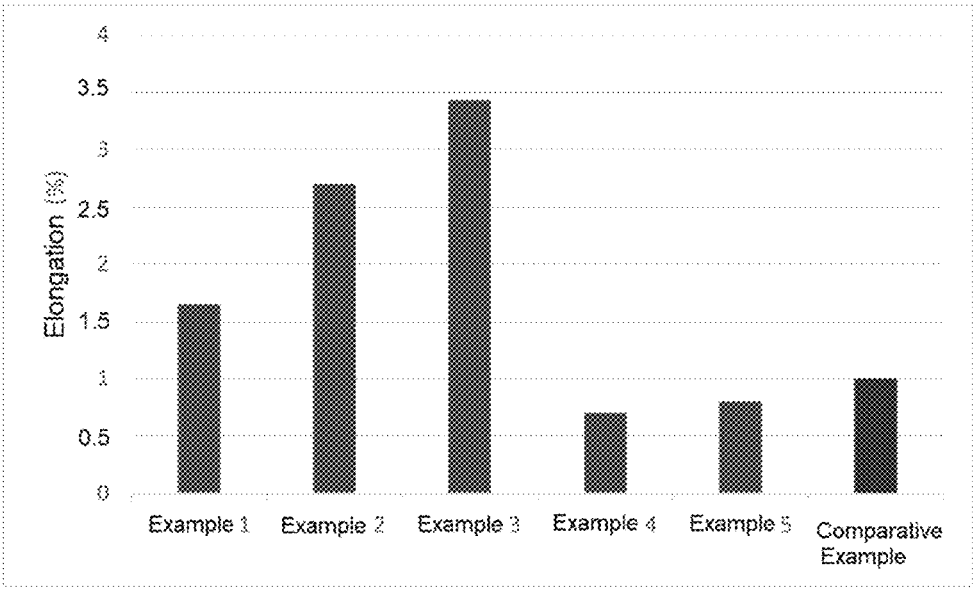
FIG. 9—Elongation results for the ferritic vermicular cast iron object of the present invention. The comparative example is for class 450 vermicular cast iron. The average elongation is 1.86% for the vermicular cast iron of the present invention.

FIGS. 7, 8 and 9 show results of strength limit, yield limit and elongation limit of the ferritic vermicular cast iron of the present invention, with Ferritization Factor between 3.88 and 5.48 and nodularity less than 30%.

Thus, the material claimed has high mechanical properties, especially high tensile strength, due to the ferritic matrix hardened by solid solution, combined with good machinability and also, without presenting the brittleness typical of cast irons with a high silicon content. These properties are important in the manufacture of engine blocks and heads with superior performance.

Thus, the new alloy can be used in the production of high-power density engines, which are susceptible to high levels of mechanical demand.

In this sense, the present invention also refers to an internal combustion engine head and block, manufactured in gray cast iron alloy, as defined above.

It is important to emphasize that the above description has the sole purpose of describing, by way of example, the particular embodiment of the invention in question. Therefore, it becomes clear that modifications, variations and constructive combinations of elements that perform the same function in substantially the same way to achieve the same results, remain within the scope of protection delimited by the appended claims.

The invention claimed is:

1. Vermicular cast iron alloy consisting of carbon contents in the range of 2.6% to 3.2%, manganese values between 0.1% to 0.3%, maximum phosphorus of 0.05%, chromium less than 0.06%, tin less than 0.03%, silicon ranging between 4.6% and 5.7%, copper less than 0.20%, magnesium values between 0.005 to 0.030% and cerium values between 0.005 to 0.030%;

the alloy characterized by presenting a microstructure with a metallic matrix, said metallic matrix comprising at least 90% of ferrite and up to 10% of pearlite, wherein graphite particles comprise at least 70% of vermicular graphite and nodular graphite in up to 30% of the microstructure;

wherein the alloy has a minimum strength limit of at least 500 MPa and a minimum yield limit of at least 350 MPa;

and wherein a Ferritization Factor calculated as F.F.=% Si−% Cu−10×% Sn−1.2×% Cr−0.5×% Mn is between 3.88 to 5.48.

2. Vermicular cast iron alloy, according to claim 1 characterized in that it presents graphite nodules in up to 30% of the microstructure.

3. Internal combustion engine head, characterized in that it is manufactured in vermicular cast iron alloy, as defined in claim 1.

4. Internal combustion engine block, characterized in that it is manufactured in vermicular cast iron alloy, as defined in claim 1.

5. Vermicular cast iron alloy consisting of carbon contents in the range of 2.6% to 3.2%, manganese values between 0.1% to 0.3%, maximum phosphorus of 0.05%, chromium less than 0.06%, tin less than 0.03%, silicon ranging between 4.6% and 5.7%, and copper less than 0.20%;

the alloy characterized by presenting a microstructure with a metallic matrix, said metallic matrix comprising at least 90% of ferrite and up to 10% of pearlite, wherein graphite particles comprise at least 70% of vermicular graphite and nodular graphite in up to 30% of the microstructure;

wherein the alloy has a minimum strength limit of at least 500 MPa and a minimum yield limit of at least 350 MPa;

and wherein a Ferritization Factor calculated as % Si−% Cu−10×% Sn−1.2×% Cr−0.5×% Mn is between 3.88 to 5.48.

6. Vermicular cast iron alloy consisting of carbon contents in the range of 2.6% to 3.2%, manganese values between 0.1% to 0.3%, maximum phosphorus of 0.05%, chromium less than 0.06%, tin less than 0.03%, silicon ranging between 5.6% and 5.7%, and copper less than 0.20%;

the alloy characterized by presenting a microstructure with a metallic matrix, said metallic matrix comprising at least 90% of ferrite and up to 10% of pearlite, wherein graphite particles comprise at least 70% of vermicular graphite and nodular graphite in up to 30% of the microstructure;

wherein the alloy has a minimum strength limit of at least 500 MPa and a minimum yield limit of at least 350 MPa;

and wherein a Ferritization Factor calculated as % Si−% Cu−10×% Sn−1.2×% Cr−0.5×% Mn is between 3.88 to 5.48.

* * * * *